United States Patent [19]

Kai et al.

[11] 4,381,354

[45] Apr. 26, 1983

[54] RESIN COATED SAND AND CASTING MOLDS PREPARED THEREFROM

[75] Inventors: Isao Kai; Hirotami Hosokawa; Takayuki Oda, all of Aichi, Japan

[73] Assignee: Asahi Yukizai Kogyo Co., Ltd., Nobeoka, Japan

[21] Appl. No.: 296,208

[22] Filed: Aug. 25, 1981

[30] Foreign Application Priority Data

Feb. 23, 1981 [JP] Japan ..... 56-25036
Aug. 11, 1981 [JP] Japan ..... 56-125816

[51] Int. Cl.[3] ..... B22C 1/22
[52] U.S. Cl. ..... 523/139; 428/404; 164/526; 164/527
[58] Field of Search ..... 164/527, 526, 132; 427/221; 428/404; 260/38; 523/139; 524/492

[56] References Cited

U.S. PATENT DOCUMENTS 3,138,836 6/1964 Amala ..... 164/526
3,184,814 5/1965 Brown ..... 164/526

FOREIGN PATENT DOCUMENTS 1597574 8/1970 France ..... 164/526

*Primary Examiner*—Sam Silverberg
*Attorney, Agent, or Firm*—Fleit, Jacobson & Cohn

[57] ABSTRACT

The invention relates to improvements of RCS and casting molds therefrom. The improvement resides that the resinous coating contains halogen-containing compound(s) which accelerate(s) carburizing of the resin during under heat subjected to the molten metal pouring step. Further, the resin coating comprises certain amount of pulverized metal capable of reacting under heat with separated halogen or halogen compound during the casting step and for avoiding ferrous element(s) in the castings and/or the mold(s).

2 Claims, No Drawings

RESIN COATED SAND AND CASTING MOLDS PREPARED THEREFROM

BACKGROUND OF THE INVENTION

This invention relates to a process for the preparation of resin-coated sands and molding shells, cores and the like casting molds prepared from such sands.

As is well known among those skilled in the art, resin-coated molding sands and shells, cores and the like molds prepared therefrom with use of organic resin binder(s) have been and are used broadly in the field of metal-casting technique. As an example, shell mold process, cold box process, hot box process and normal temperature hardenable mold process may be raised. The resin binders used in this engineering field must have high thermal strength so as to be durable even in contact with molten metal poured at the casting stage. Thus, higher heat resistant and thermally stable resin materials such as phenolic, furan-, urea- and/or urethane resin.

As the casting metal, iron and its alloys, cast steel, non-ferrous metals may be raised.

In the case of lower temperature casting metals such as aluminium and its alloys, the molds are not subjected to such a thermal history as enough to easily decompose mechanically the molds after casting for the recovery the contained sand for its reuse. In other words, the collapsability of the molds after casting is very poor, thus a large quantity of heat energy and labor must be consumed for the later sand separation and recovery.

In the case of pig iron castings, on the other hand, especially those for the production of automotive parts as an example, they are made as thinner as possible for the purpose of attaining lower fuel consumption rate of the vehicle. In addition, the whole design and configuration of these parts are becoming rather more complicated. These tendencies accelerate disadvantage of increased sand residual in the cast products. After all, labor cost for separation and cleaning of such residual sand from the castings is still increasing.

On the other hand, in the case of steel castings for which rather higher pouring temperature must be adopted, the residual strength of the molds is rather too much high, thus resulting in liable crack formation in the cast steel products. Therefore, the range of use of resin-coated sand molds has been rather limited.

Therefore, it will be seen that in the prior art there is a grave problem, which is very difficult to solve, such that the higher the thermal strength of the binders is to be met in the casting stage with the shell molds including these binders, so the collapsability of the molds would become lesser. Therefore, sand separation will require more energy and labor.

SUMMARY OF THE INVENTION

It is, therefore, a main object of the present invention to provide such improved mold material and molds made therefrom that the superior and higher thermal durability and strength of the conventional organic casting binders are maintained, yet the collapsability of the molds and sand-separability thereof as to be brought about after metal casting stage can be substantially improved on account of largely reduced residual mechanical strength of the molds as appearing after such casting stage.

For satisfying the above technical object, a composition which comprises hardenable substance 0.3–10 wt. parts and halogen-containing organic compounds(s) 0.001–10 wt. parts, based upon 100 wt. parts of material sand, is used for coating the latter. The halogen-containing organic compound or compounds are selected from those which accelerate carbonization of the hardenable substance.

The halogen-containing organic compound or compounds may be selected from paraffin chloride; paraffin bromide; polyethylene chloride, polyethylene bromide; polyphenyl bromide; polyphenyl perchloride; perchloropentacyclodecane ("Dechlorane"); "Dechloraneplus" manufactured and sold by Hooker Chemical Corporation, Niagara Falls, N.Y., tetrabromoethane; tetrabromobutane; dibromoethane; 1,2-dibromo-3-chloropropane; 1,2,3-tribromopropane; hexabromocyclododecane; tetrabromobenzene; diphenylchlomate; tetrabromobisphenol-A; tetrabromophthalic anhydride; hexabromobenzene; hexabromocyclododecane; bis(bromoethylether); tetrabromobisphenol-A; dibromoneopentyl glycol; pentabromochlorocyclohexane; decabromodiphenyl oxide; ethyl-tetrabromobisphenol-A; pentabromomonochlorocyclohexane; dibromoneopentyl glycol polyester; hydroxymethyl ureidomethyl phosphonium chloride, trisdichloropropyl phosphate and the like. Most of these compounds carry halogen atoms on side chains.

In the present invention, the composing amount of the said carbonization accelerating substance is in the ratio of 0.001–10 wt. parts relative to the sand, 100 wt. parts.

With less than 0.001 wt. part of said accelerating substance, the desired partial carbonization can not be realized and on account of insufficient concentration of halogen atoms which is caused by smaller composing ratio of the said accelerator(s) relative to the resin binder(s).

On the contrary, with higher adding ratio than 10 wt. parts, generating gases will be disadvantageously large and the resin-hardening velocity at the shell-forming stage will become smaller than desired which are naturally disadvantageous in the art. Preferable composing ratio extends 0.001 to 5.0 wt. parts relative to 100 wt. parts of the sand.

When necessary, the halogen-containing organic compound(s) may be added beforehand to the hardenable resin(s).

Further, if necessary, the halogen-containing compound(s) may be added simultaneously at the resin-coating stage for the sand, without injuring the desired effect.

As the hardenable resin(s) usable in the invention, any of those which are thermally hardenable, aero-hardenable or normal temperature-hardenable, can be employed. As an example, phenolic resin, furan resin, urea resin, phenolurethane resin, unsaturated polyester resin, silicone resin, butadiene resin, acylylic resin, alkydurethane resin and the like. In the present invention, it should be stressed that almost no limitation should be made to the kind of the hardenable resin, so far as it be hardenable.

With addition quantity less than 0.3 wt. part relative to the sand, 100 wt. parts, we have experienced that only insufficient coverage on the sand particles can be realized. On the other hand, if a larger quantity of the hardenable resin than 10 wt. parts thereof be used relative to 100 wt. parts of the sand, gas generation would be considerable at the metal casting stage, which will result in casting defects such as cracks, in spite of correspondingly increased shell mold forming cost. Therefore, it is highly recommendable to use 0.5–5.0 wt. parts of the resin based on 100 wt. parts of the sand.

As for the sand usable in this invention, it must not always be composed of 100% of $SiO_2$. Every kind of sand which is commonly used for the molding purpose can be utilized. As an example, olivin sand, zircon sand or the like, conventional shell-forming mineral particles may be used.

Most of the halogen-containing organic compounds usable in the present invention and adapted for accelerating thermally partial carbonization of the hardenable resin(s) belong to the class pf so-called antiburning agents. However, it should be noted that the invention is not limited only to the use of such class of agents mentioned above.

With use of the above prepared resin-coated sands and by use of casting molds prepared from such sands, certain troubles may arise especially when the cast produsct(s) may comprise iron part(s) as in the case of iron-lined aluminium cylinder(s) for high speed internal combustion engines. In such a case, when the core is made of resin-coated sand, while the main or outer mold is made of steel, as in the case of die casting technique, similar difficulty may arise.

In the cating stage, halogen-containing gas(es) will thermally separated from the halogen-containing compound or even from the hardenable resin per se and by contact with the high temperature pouring metal, and these gases will cause to develop corrosion or the like surface defect on the iron part(s) or ferrous die.

According to our experiments, such corrosion or the like surface defect caused by the halogen gas attach can be substantially suppressed by adding a properly selected amount of pulverized metal which is capable of uniting with halogen under high temperature condition as may be met in the molten metal pouring stage.

The pulverized metal can preferably be added with the sand-coating composition, or may be added to the resin coated sand during the mold-forming stage. These metals which belong to the alkali earth metal group, such as Ba, Sr, Ca and Mg are preferable to use. Further, several metals which are called transition elements, such as Zn, Fe, Cd and Co, are also preferable to use.

Among others, Zn is most suitable from the economical point of view as well as its superior effect.

The usable amount of such metal or metals ranges from 0.0001 to 10 wt. parts based on 100 wt. parts of the sand.

The halogen-catch performance of such metal could be expressed in the following general formula, when the metal is expressed by M and the halogen by X:

$$M+X=MX_n$$

where, n being 2 or 3.

On the other hand, depending upon the kind and nature of the hardenable resin, HX may be separated during the molten metal pouring stage, then the following reaction may also occur:

$$M+HX \rightarrow MX+H_2$$

In the following, several preferred numerical examples will be set forth for better understanding of the invention.

EXAMPLE 1

Silicieous sand, commercially available in Japan, under the trade name of "Sankei—6 GO", 10 kg, was heated up to and maintained at 150 deg. C. The quantity was measured on "Speed Mixer", manufactured and sold by a Japanese firm, Enshu Iron Works, Ltd.

On the other hand, novalak type phenolic resin, 250 g, and tetrabromobisphenol—A, 50 g, were mixed together and introduced into the said mixer and subjected to mixing for 50 seconds. Then, hexamethylenetetramine 37.5 g and water, 150 g, were charged and subjected to further mixing for 40 seconds. Then, calcium stearate, 5 g and pulverized zinc 30 g, were added. In this way, desired resincoated sand (hereinafter briefly, to be described only "RCS".

EXAMPLE 2–5

Substantially in line with the foregoing composing doses described in Example 1, however, with several different amounts of thermal carbonization accelerating agent(s) and halogen-catching metal powder, RCS was prepared. The results are will be shown in the following Table 1.

In the comparative experiment to be described no use was made of the carbonization accelerator and pulverized metal. Other composing ratios were same as those which were employed in Example 1.

Testing methods for the evaluation of the resulted RCS were as follows:

| | |
|---|---|
| transverse test | in accordance with provisions of JISK - 6910; |
| bending test | JACT-test method, SM-3; |
| sticking point determination | JACT-test method, C-1; |

collapsability determination test:

A core specimen, 40 mm wide, 75 mm long and 25 mm thick, was prepared.

On the other hand, a hollow cylindrical shell specimen, 125 mm × 80 mm × 70 mm, was prepared. Its hollow cylindrical space had enough sizes to contain the said core piece with ample cavity space.

These both specimens were coupled together, and molten aluminium alloy was poured at 700 deg.C into the hollow cylindrical cavity and cooled down.

With use of a compressed air hammer type vibrator, vibrations were applied to the cast metal at a pressure of 1.4 kg/cm$^2$ and collapsed and shaked-out sand was measured substantially at time intervals. The mold-and-cast metal assembly thus formed had an outlet opening of 10 mm-diameter.

The collapsability was expressed by measuring the weight of the discharged sand through the said output opening from inside and in terms of the percentage relative to the total sand content.

As seen from Table 1, in Examples 1 and 2, the collapsability amounted 100% at the first measuring time 5 seconds during which, vibrations were continuously applied. This applies to also Example 5. In the case of Examples 3 and 4, the collapsability amounted to 75% and 36%, respectively at the first measuring instance of 5 seconds. The collapsability amounted to 100% in these Examples at the second measuring instance which occured after 10 seconds from initiation of the application of vibrations.

In the case of the comparative experiment shown in Table 1, the collapsability 100% reached at the last or sixth measuring period which means the vibration application was made, indeed, for a time duration of 80 seconds.

The outlet sand was a mixture of sand masses and fine sand particles. The mixture was passed through a 10-mesh sieve and the real collapse rate, %, was determined by the following formula (1):

$$\text{the real collapse rate, \%, } = \frac{\text{sand amount passed through 10-mesh seive}}{\text{sand amount of larger sizes than 10-mesh}} \times 100$$

For determining the residual strength, in each case shown in Table 1, we prepared a round bar specimen, 22.5 mm, dia., and 50 mm long which was kept in a furnace at 500 deg. C. The compressive strength was measured at time intervals after being taken out from the furnace and upon cooling.

In the following Table 1, the added quantity of antiburning agent is based on 100 wt. parts of the sand.

TABLE 1

| | Example 1 | Example 2 | Example 3 | Example 4 | Example 5 | Comparative experiment |
|---|---|---|---|---|---|---|
| Antiburning agent, wt. parts | 0.5 | 0.2 | 0.05 | 0.01 | 1.0 | 0 |
| zinc powder, in wt. parts | 0.3 | 0.1 | 0.03 | 0.005 | 1.0 | |
| Flextural strength, kg/cm$^2$ | 38.7 | 45.0 | 47.4 | 38.0 | 40.0 | 37.4 |
| Bend test, minimum radius, in mm | 0.32 | 0.20 | 0.15 | 0.18 | 2.5 | 0.17 |
| Sticking point, deg. C. | 110 | 109 | 111 | 112 | 100 | 111 |
| Collapsability, % | | | | | | |
| 5 sec. | 100 | 100 | 75 | 36 | 100 | 0 |
| 10 sec. | | | 100 | 100 | | 0 |
| 20 sec. | | | | | | 5 |
| 40 sec. | | | | | | 23 |
| 60 sec. | | | | | | 80 |
| 80 sec. | | | | | | 100 |
| Real collapsing rate, % | 80 | 77 | 75 | 63 | 98 | 41 |
| Residual strength, % | | | | | | |
| 0 | 100 | 100 | 100 | 100 | 100 | 100 |
| 10 min. | 78 | 80 | 83 | 82 | 65 | 96 |
| 20 min. | 62 | 65 | 68 | 71 | 30 | 93 |
| 30 min. | 25 | 30 | 32 | 38 | 10 | 83 |

EXAMPLE 6

400 kg of recovered sand as obtained from a conventional fluidized-solids roaster, and 8 kg of solid resol type phenolic resin were used for the preparation of RCS in the dry hot resin-coating process. However, in this case, 1.6 kg of dibromoneopentyl glycol, manufactured and sold by The Dow Chemical Company, Midland, Mich., under the tradename: "SA—1138" were added to.

With the thus prepared RCS, a core mold adapted for casting an automotive engine intake manifold was formed. On the other hand, a similar core mold using, 2 wt. parts of resol type phenolic resin per 100 parts of sand was formed for comparison with the former.

For mold's collapse and sand separation after metal casting, a heating step at 400 deg. C for 4 hours was necessary. However, in the present example, such after-heating step could be completely dispensed with and more mechanical vibration step only was employed for the desired purpose. Sand separation was of 100%-degree.

EXAMPLE 7

At first, dibromoethane was admixed in noovolak type phenolic resin in a wt. ratio of 10:9, thus providing a kind of modified resin. Then, the latter, 3 wt. parts, was added to recovered sand, 100 wt. parts, from already used shell molds in a fluidized-solids roaster. Then, this modified resin and the recovered sand were mixed together under heat for the preparation of RCS in the dry hot process as usual.

Test specimens prepared from this RCS showed:

| | |
|---|---|
| flexture strength: | 55 kg/cm$^2$; |
| min. bending radius: | 0.3 mm; |
| sticking point: | 105 deg. C.; |

These characteristic values may be deemed as those of conventional shell molds.

With use of this RCS, several molding cores were prepared for casting cooling jackets of automotive engine cast blocks. After casting, cooling and mold-dismantling, residual sand quantities were measured as shown in the following Table 2.

TABLE 2

| Inspections: | conventional | Example 7 |
|---|---|---|
| 1st | 10 g | 5 g |
| 2nd | 30 g | 1 g |
| 3rd | 50 g | 0 |
| 4th | 40 g | 0 |
| 5th | 100 g | 0.5 g |

These results shown that with use of the improved RCS, after-treatment job for sand separation can be substantially minimized.

EXAMPLE 8

Thermal spring siliceous sand, 100 wt. parts, were added with furan resin 1.0 wt. parts (manufactured and sold by Asahi Yukizai Kogyo K.K., under tradename "HP—4021") and water-soluble paratoluenesulfonic acid, 0.6 wt. part, and further with tetrabromobutane, 0.24 wt. part, for the production of RCS under heat.

With this RCS, then, solid cylindrical test specimens, 50 mm×50 mm, were prepared.

Similar specimens were also prepared for comparison, and indeed, with use of none of tetrabromobutane. The comparative test results were as per those enlisted in the following Table 3.

TABLE 3

| | Comparative experiment | Example 8 |
|---|---|---|
| Compressive strength, kg/cm$^2$ | | |
| 10 min. | 1.0 | 0.5 |
| 60 min. | 15.0 | 18.0 |
| 3 hours | 23.0 | 25.2 |
| 24 hours | 35 | 38 |
| Residual compressive | | |

TABLE 3-continued

| | Comparative experiment | Example 8 |
|---|---|---|
| strength, % | | |
| 0 min. | 100 | 100 |
| 1 min. | 50 | 10 |
| 2 min. | 20 | 0 |
| 3 min. | 15 | 0 |
| 4 min. | 10 | 0 |
| 5 min. | 0 | 0 |

EXAMPLE 9

Siliceous sand ("Sanei 6—go), 100 wt. parts were added with benzyl ether type phenolic resin 1.5 wt. parts, added, however, with 15 wt. % of the tetra-bromo-bisphenol-A, and polyisocyanate 1.2 wt. parts and CRS was prepared as being adapted for the cold box shell molding process.

In any of the foregoing Example 6–9, no amount of halogen-catching metal powder was used.

In this case, when the casting included ferrous part, the latter showed instantly a large amount of red rust at the molten metal pouring stage.

However such rust could be effectively suppressed by addition of a small amount of halogen-catching metal powder, such as Zn. The amount may range from 0.0001–10 wt. parts relative to 100 wt. parts of the sand. Most preferable range was 0.001–1 wt. parts based on 100 wt. parts of the sand.

In place of the foregoing zinc powder, several other metals selected from the transition elements, Mn, Fe and/or Cd may be used for the same purpose.

Equally, any of the members of alkali earth metal series could be used by use of equivalent quantity.

EXAMPLE 10

A composition comprising recovered sand, 200 kg, obtained on a conventional fluidized bed roaster from once used shell molds, Novolak type phenolic resin 3.2 kg, tetrabromobisphenol—A 0.8 kg and pulverized zinc 0.4 kg, was used for the manufactre of resin-coated sand.

A solid core was prepared from this RCS so as to cast an aluminium monocylinder of an air-cooled bike engine and by the die casting process. Molten aluminium was poured at 720 deg. C. The cylinder had inner sizes of 210 mm×130 mm×110 mm, weighing 3.7 kg.

Otherwise appeared heavy red rust formation was completely suppressed. For the sand separation, no shell baking was used. 100%-sand separation was realized by exclusively relying upon mechanical vibration.

The embodiments of the invention in which an exclusive property or privilege is claimed are as follows:

1. A resin-coated sand having a surface coating comprising, based on 100 wt. parts of the sand, 0.3–10 wt. parts of hardenable resin, and 0.001–10 wt. parts of halogen-containing organic compound having a strong tendency of carburizing said hardenable resin under heat, further comprising 0.0001–10 wt. parts of pulverized metal capable of acting with halogen under heat.

2. Casting mold made of the resin-coated sand accordance to claim 1.

* * * * *